US007577374B2

(12) United States Patent
Kamisuwa et al.

(10) Patent No.: US 7,577,374 B2
(45) Date of Patent: Aug. 18, 2009

(54) IMAGE FORMING APPARATUS AND METHOD OF CONTROLLING THE APPARATUS

(75) Inventors: Yoshikatsu Kamisuwa, Tokyo (JP); Katsuya Nagamochi, Tokyo (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/186,379

(22) Filed: Aug. 5, 2008

(65) Prior Publication Data

US 2008/0298830 A1 Dec. 4, 2008

Related U.S. Application Data

(63) Continuation of application No. 11/421,354, filed on May 31, 2006, now Pat. No. 7,460,807.

(51) Int. Cl.
*G03G 15/00* (2006.01)
*G03G 21/00* (2006.01)

(52) U.S. Cl. ..... 399/81; 399/38

(58) Field of Classification Search ..... 399/81, 399/38

See application file for complete search history.

(56) References Cited

U.S. PATENT DOCUMENTS 6,885,829 B2 * 4/2005 Braun et al. ..... 399/81 X
2001/0026699 A1 * 10/2001 Ishikura ..... 399/81

* cited by examiner

*Primary Examiner*—Sophia S Chen
(74) *Attorney, Agent, or Firm*—SoCal IP Law Group LLP; Steven C. Sereboff; John E. Gunther

(57) ABSTRACT

When an adjustment mode is set, a designation screen is displayed on a liquid crystal display screen. A part as an object of adjustment is designated by a touch operation to the designation screen. Subsequently to this designation, an input screen for inputting data for adjustment is displayed.

15 Claims, 9 Drawing Sheets

IMAGE FORMING APPARATUS AND METHOD OF CONTROLLING THE APPARATUS

RELATED APPLICATION INFORMATION

This application is a continuation of application Ser. No. 11/421,354, entitled "Image Forming Apparatus and Method of Controlling the Apparatus", filed May 31, 2006.

NOTICE OF COPYRIGHTS AND TRADE DRESS

A portion of the disclosure of this patent document contains material which is subject to copyright protection. This patent document may show and/or describe matter which is or may become trade dress of the owner. The copyright and trade dress owner has no objection to the facsimile reproduction by anyone of the patent disclosure as it appears in the Patent and Trademark Office patent files or records, but otherwise reserves all copyright and trade dress rights whatsoever.

BACKGROUND

1. Field

This disclosure relates to image forming apparatus.

2. Description of the Related Art

An image forming apparatus, such as a copying machine, optically reads an image of a document set on a document table and prints the read image onto a paper sheet by a printer. The printer includes a photosensitive drum, a charging unit, a developing unit, a transfer unit, a peeling unit, a cleaner, a charge-removal unit, a fixing unit and the like.

In the case where the image forming apparatus as stated above is used, according to use environment, it becomes necessary to adjust, for example, a grid bias voltage of the charging unit, a developing bias voltage of the developing unit or the like. This adjustment work is performed by a service man The service man performs a specified operation by a control panel of the image forming apparatus to set an adjustment mode, and further confirms a code corresponding to a part as an object of adjustment by using a manual or the like, and inputs the code. By this input, an input screen relating to the part as the object of the adjustment is displayed by the control panel, and the grid bias voltage or the developing bias voltage can be adjusted by data input to the input screen.

However, with the advance of digitization, colorization, and increase in functionality of the image forming apparatus, the number of codes for adjustment is increased from several hundred to several thousand. It is impossible for the service man to memorize all the codes, and the code must be confirmed by referring to a thick manual at each time of adjustment. Thus, there is a problem that the efficiency of the adjustment work is very poor.

Even if the service man memorizes some codes, in a new type of image forming apparatus, the function is changed, or a new function is added. Thus, it becomes necessary to arrange a group of codes, and it becomes impossible to use the codes memorized at great pains.

BRIEF SUMMARY OF THE INVENTION

An object of an aspect of the invention is to provide an image forming apparatus in which it is unnecessary to memorize codes, it is unnecessary to refer to a manual, and a part as an object of adjustment can be easily designated, and by this, the efficiency of adjustment work is greatly improved.

An image forming apparatus according to an aspect of the invention includes a display part, a first control section that sets an adjustment mode relating to plural parts of the apparatus, a second control section that causes the display part to display at least one designation screen having an image display of the plural parts and for receiving designation of each of the parts of the image display at a time of setting of the adjustment mode, a third control section that cause the display part to display at least one input screen for inputting data for adjustment relating to designated content of the designation screen, and a fourth control section that performs an adjustment corresponding to input content of the input screen Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION

Hereinafter, a first embodiment of the invention will be described with reference to the drawings.

Figure 1:
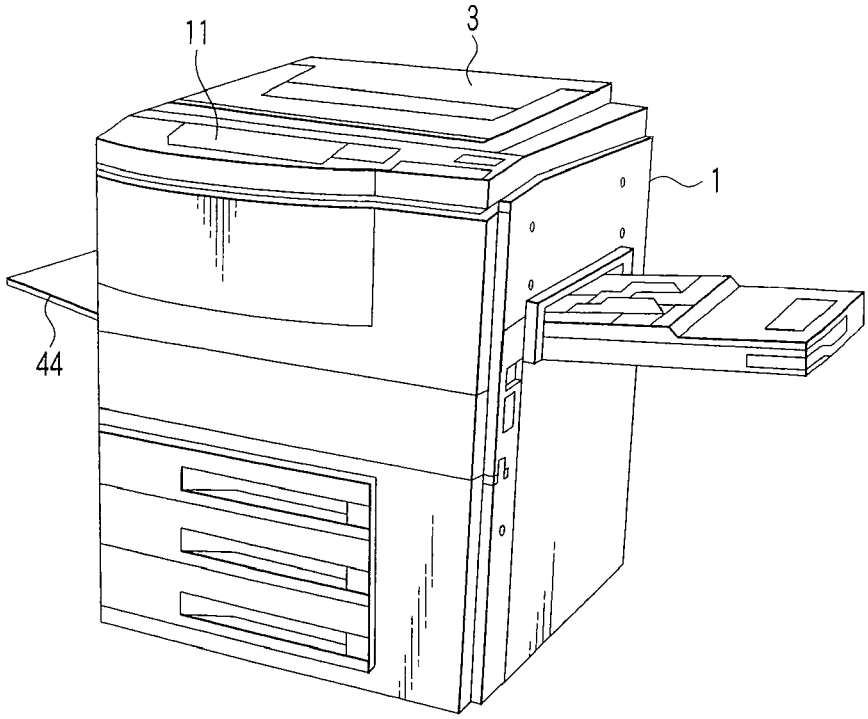
FIG. 1 is a view showing an outer appearance in respective embodiments.
Figure 2:
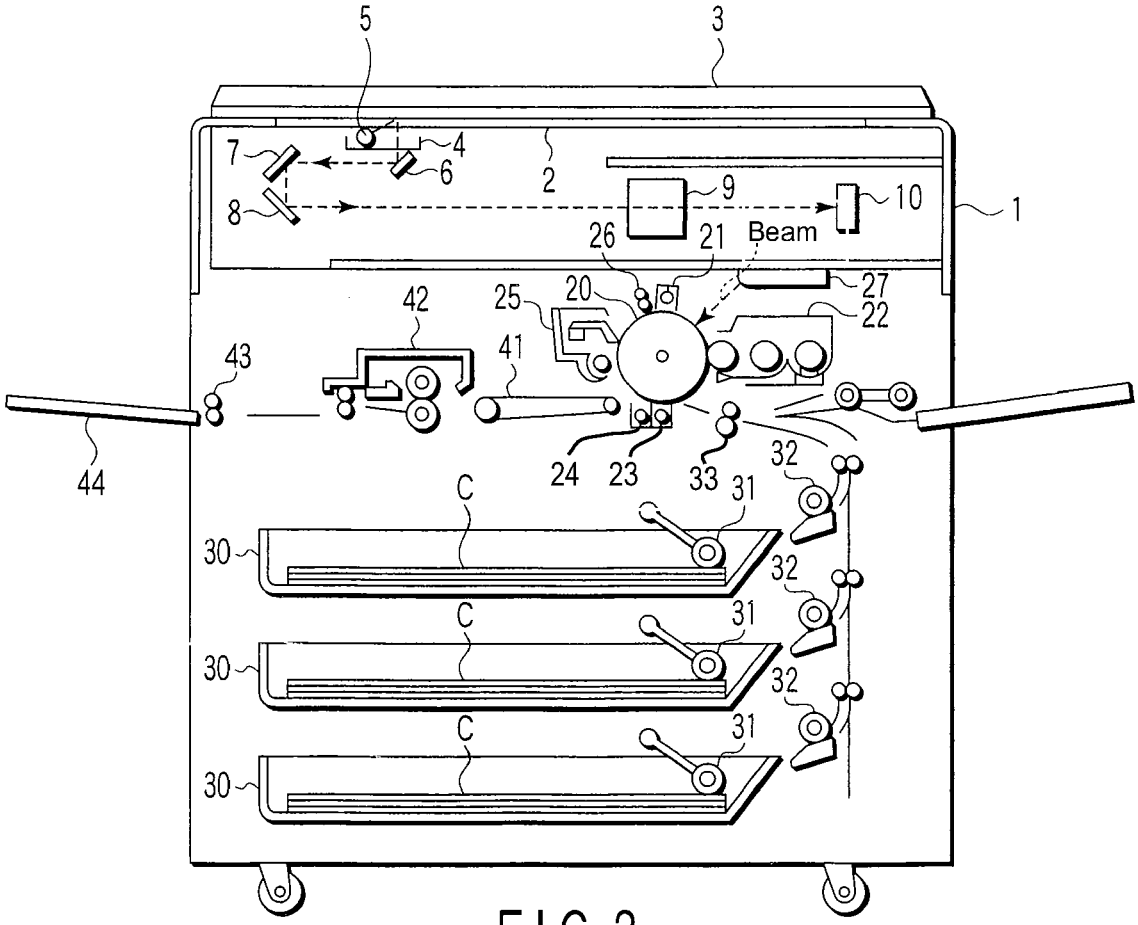
FIG. 2 is a view showing an inner structure in the respective embodiments.
Figure 3:
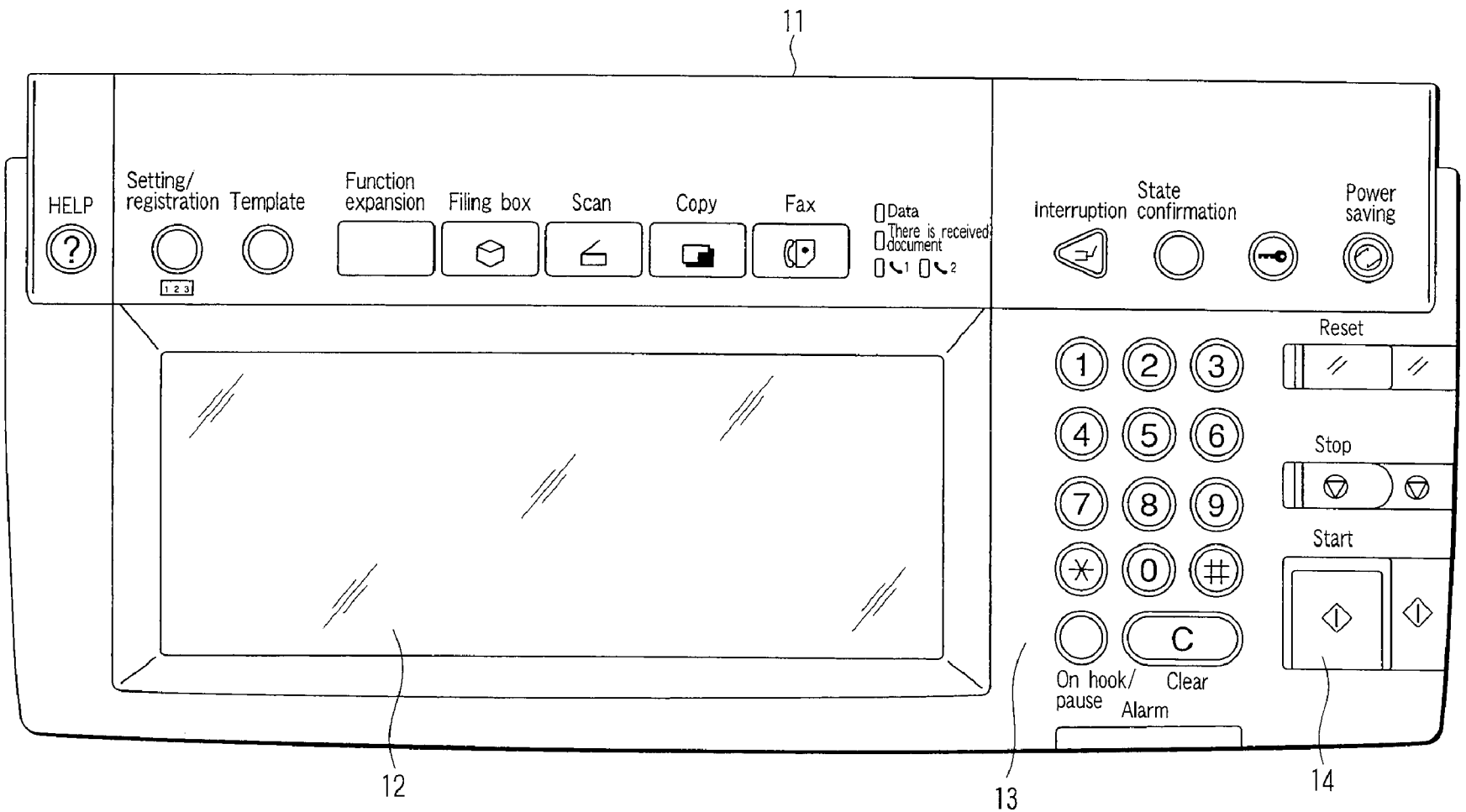
FIG. 3 is a view showing a control panel in the respective embodiments.

As shown in FIG. 1 and FIG. 2, a transparent document table (glass plate) 2 for document setting is provided at an upper part of a body 1, and a platen cover 3 is openably/closably provided on the document table 2. Besides, a control panel 11 is provided at a position having the same height as that of the document table 2 in the upper part of the body 1. As shown in FIG. 3, the control panel 11 includes a touch panel type liquid crystal display part 12 as a display part, and includes, as an operation part, a numeric keypad 13 and a start button 14

A carriage 4 is provided at a lower side of the document table 2, and an exposure lamp 5 is provided in the carriage 4. An exposure section (exposure means) includes the carriage 4 and the exposure lamp 5. The carriage 4 can reciprocate along the lower surface of the document table 2. The exposure lamp 5 is turned on while the carriage 4 reciprocates, so that the document set on the document table 2 is exposed to light.

By this exposure, a reflected light image of the document set on the document table 2 is obtained, and that is projected on image signal output means, for example, a CCD (Charge Coupled Device) 10 through reflecting mirrors 6, 7 and 8 and a scaling lens block 9. The CCD 10 outputs a signal with a voltage level corresponding to the amount of received light.

A scanner (after-mentioned scanner 68) for optically read the document set on the document table 2 includes the carriage 4, the exposure lamp 5, the reflecting mirrors 6, 7 and 8, the scaling lens block 9 and the CCD 10.

The image signal outputted from the CCD 10 is amplified and is converted into a digital signal, and after the digital signal is processed by an after-mentioned image processing part 74, it is supplied to a laser unit 27. The laser unit 27 emits a laser beam corresponding to the input signal.

A photosensitive drum 20 is rotatably provided at substantially the center in the body 1. A charging unit 21, a developing unit 22, a transfer unit 23, a peeling unit 24, a cleaner 25, and a charge-removal unit 26 are successively provided around the photosensitive drum 20. The laser beam emitted form the laser unit 27 passes through between the charging unit 21 and the developing unit 22 and is irradiated onto the surface of the photosensitive drum 20.

Plural cassettes 30 are provided at a bottom in the body 1. Many paper sheets C having sizes different from one another are contained in these cassettes 30. When the after-mentioned start key 14 is turned on, the paper sheet C is taken out one by one from one of the cassettes 30. A pickup roller 31 for taking out the sheet is provided for each of the cassettes 30. The taken-out paper sheet C is separated from the cassette 30 by a separating unit 32, and is sent to a register roller 33. The register roller 33 sends the paper sheet C to between the photosensitive drum 20 and the transfer unit 23 at timing taking account of the rotation of the photosensitive drum 20.

The charging unit 21 applies a high voltage to the photosensitive drum 20, so that the surface of the photosensitive drum 20 is charged with static electricity. The laser beam emitted from the laser unit 27 is irradiated onto the surface of the photosensitive drum 20 which has been charged. By this irradiation, an electrostatic latent image corresponding to the image read by the scanner is formed on the surface of the photosensitive drum 20.

The electrostatic latent image formed on the photosensitive drum 20 receives a developer (toner) from the developing unit 22 so that the image is revealed. This revealed image is transferred to the paper sheet C by the transfer unit 23. The paper sheet C having subjected to the transfer is peeled off from the photosensitive drum 20 by the peeling unit 24. The developer and electric charge remain on the surface of the photosensitive drum 20 from which the paper sheet C is peeled off. The remaining developer is removed by the cleaner 25. The remaining charge is removed by the charge-removal unit 28

The paper sheet C peeled off from the photosensitive drum 20 is sent to a fixing unit 42 by a transport belt 41. The fixing unit 42 fixes the image transferred on the paper sheet C by heat. The paper sheet C having subjected to the fixing is discharged to a tray 44 by a paper discharge roller 43.

A printer (after-mentioned printer 69) to print an image read by the scanner onto the paper sheet C includes the structure from the photosensitive drum 20 to the tray 44.

Figure 4:
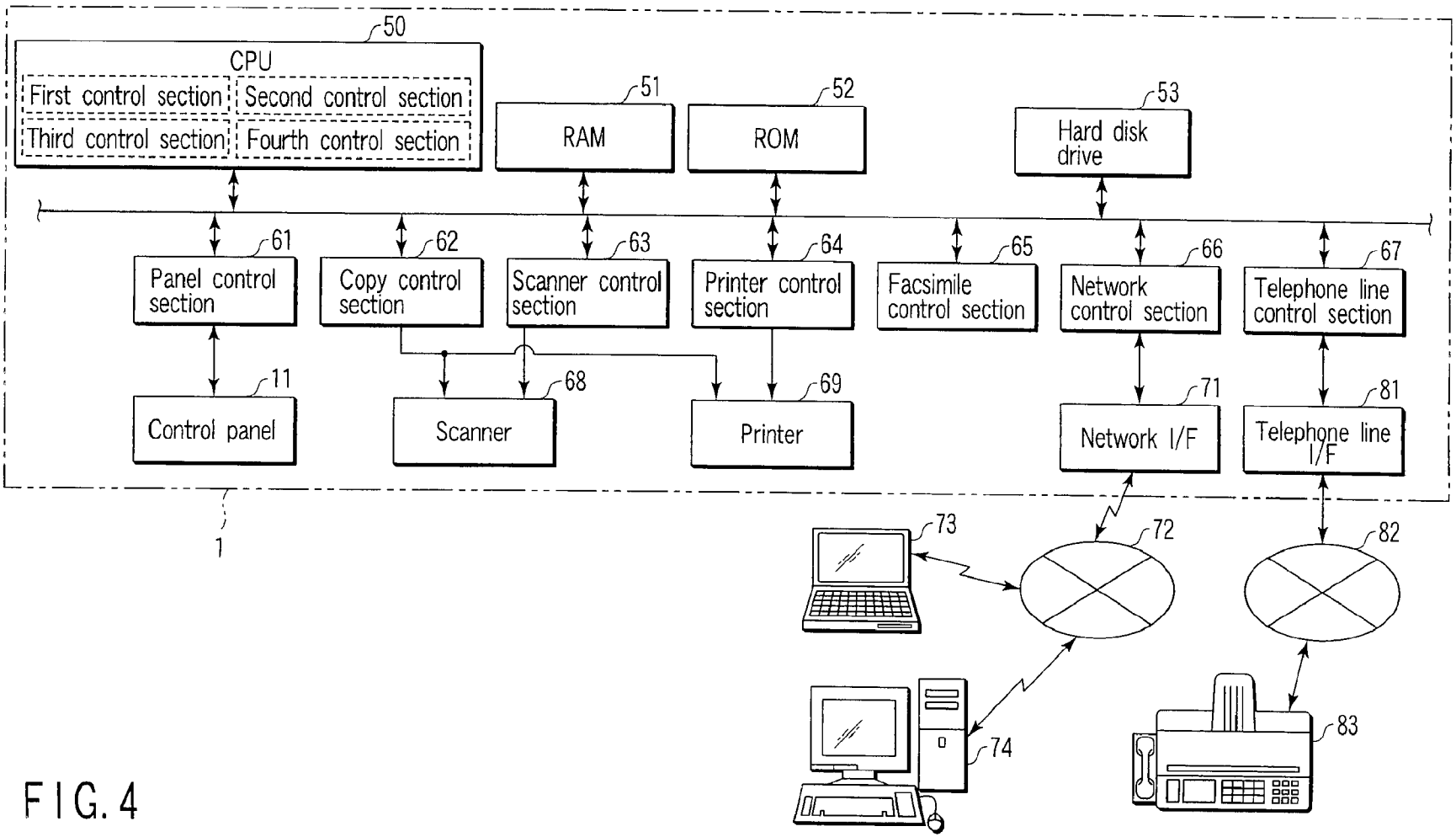
FIG. 4 is a block diagram of a control circuit in the respective embodiments.

A control circuit is shown in FIG. 4.

A CPU 50 as a main control section is connected with a RAM 51, a ROM 52, a hard disk drive (HDD) 53, a panel control section 61, a copy control section 62, a scanner control section 63, a printer control section 64, a facsimile (Fax) control section 65, a network control section 66, and a telephone line control section 67.

The RAM 51 is for storing various data. Various control programs necessary for the operation of the body 1 are stored in the ROM 52. The scanned image data are stored in the hard disk drive 53.

The panel control section 61 controls the control panel 11. The copy control section 62 controls a normal copy function using the scanner 68 and the printer 69. The scanner control section 63 controls scan functions (scan to box function, scan to file function, scan to E-mail function) using the scanner 68. The printer control section 64 controls a network print function using the printer 69.

The network control section 66 controls data transmission/reception to/from a communication network 72 through a network interface 71. The communication network 72 is connected with external equipments, for example, personal computers 73 and 74. The telephone line control section 67 controls communication to a public telephone line 82 through a telephone line interface 81. The connection between the body 1 and a facsimile apparatus 83 becomes possible by this public telephone line 82. The facsimile control section 65 uses the network control section 66 and the telephone line control section 81 and controls facsimile transmission.

The CPU 50 includes following means (1) to (4) as main functions.

(1) A first control section that sets an adjustment mode relating to plural parts of the apparatus according to an operation of the control panel 11. The plural parts are, for example, plural parts in the printer 69.

(2) A second control section that causes the liquid crystal display part 12 of the control panel 11 to display at least one designation screen A having an image display of the plural parts and for receiving designation of each of the parts of the image display at a time of setting of the adjustment mode.

(3) A third control section that causes the liquid crystal display part 12 of the control panel 11 to display at least one input screen B for inputting data for adjustment relating to designated content of the designation screen A.

(4) A fourth control section that performs an adjustment corresponding to input content of the input screen B.

Figure 5:
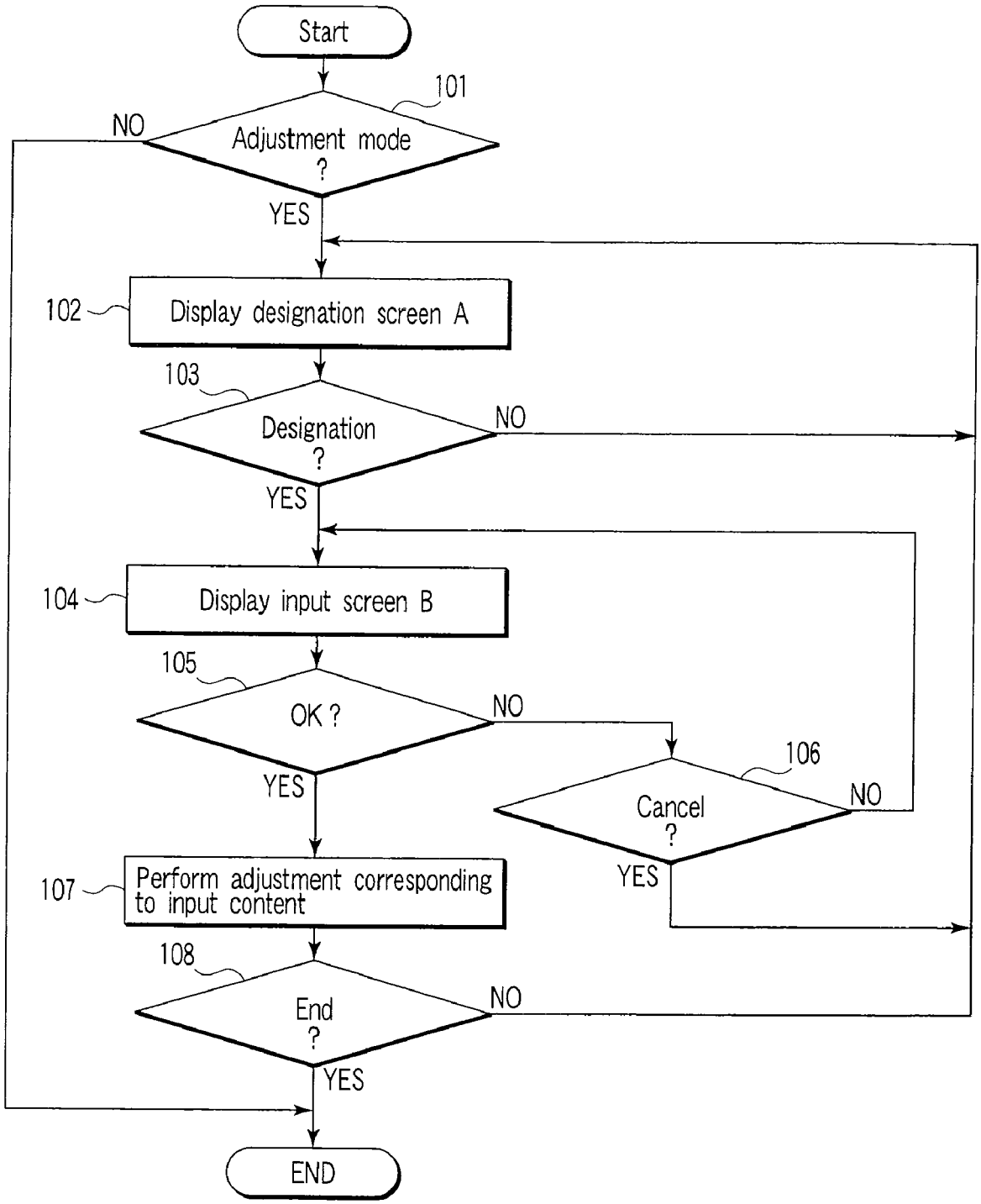
FIG. 5 is a flowchart for explaining an operation in a first embodiment.

Next, the operation will be described with reference to a flowchart of FIG. 5.

In the case where an abnormality of picture quality, for example, fogging occurs in a printed image, and the abnormality is not improved even if an automatic adjustment function operates, it is necessary to finely adjust the grid bias voltage of the charging unit 21. The fogging means that contamination due to toner occurs in a non-print area of a paper sheet.

In this case, the service man inputs a code of an adjustment mode by the operation of the control panel 11. The adjustment mode is set by this input (YES at step 101).

Figure 6:
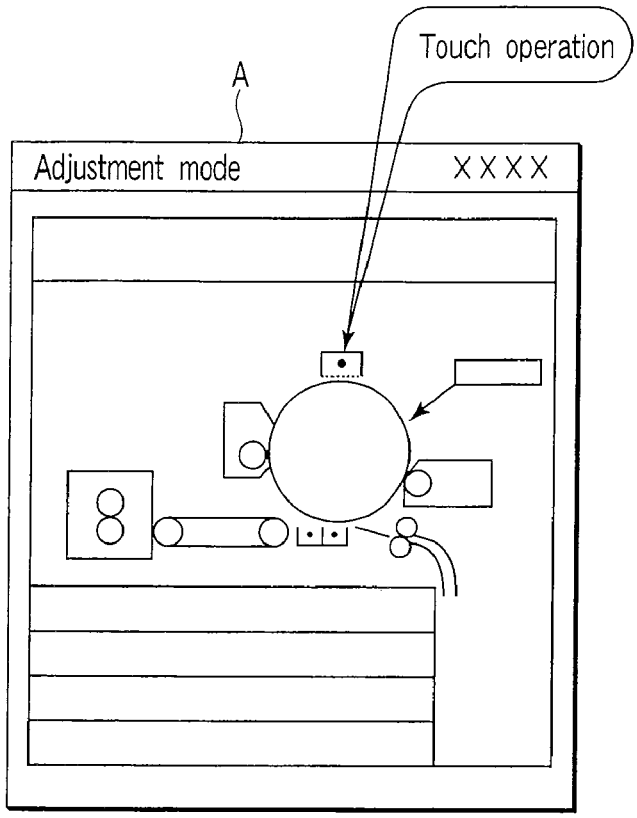
FIG. 6 is a view showing a designation screen in the first embodiment.

When the adjustment mode is set (YES at step 101), a designation screen A shown in FIG. 6 is displayed on the liquid crystal display part 12 of the control panel 11 (step 102) The designation screen A has a display of a mode name "adjustment mode" and a code for adjustment "XXXX", and has an image display of the photosensitive drum 20, the charging unit 21, the developing unit 22, the transfer unit 23, the peeling unit 24, the cleaner 25, the laser unit 27, the register roller 33, the transport belt 41, the fixing unit 42 and the like in the printer 69, and is for receiving the designation of a touch operation to each part of the image display.

Figure 7:
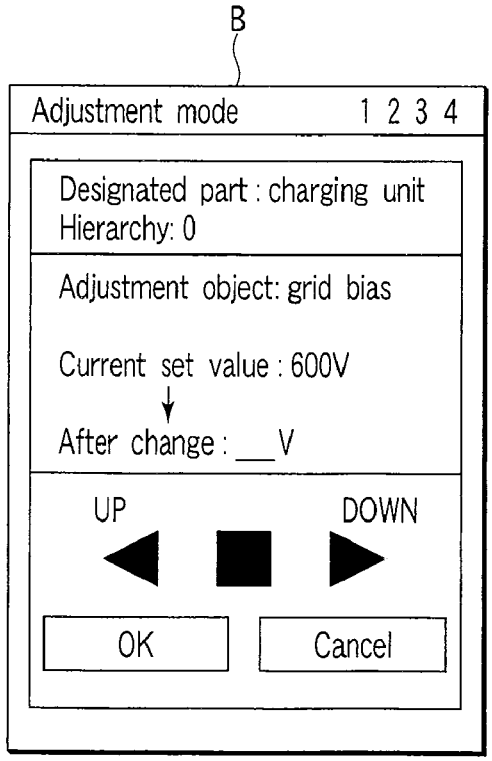
FIG. 7 is a view showing an input screen in the first embodiment.
Figure 8:
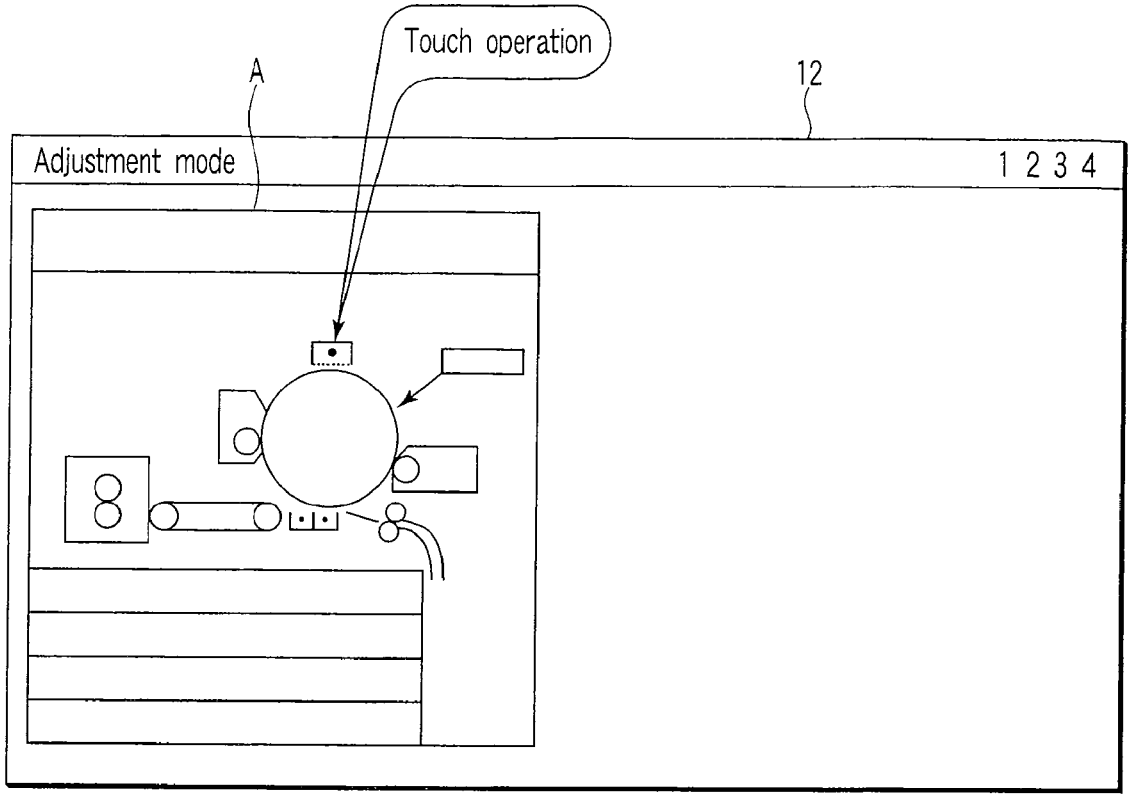
FIG. 8 is a view showing a designation screen in a second embodiment.

When a portion of, for example, the charging unit 21 of the image display of the designation screen A is designated by the touch operation (YES at step 103), an input screen B shown in FIG. 7 is displayed on the liquid crystal display part 12 of the control panel 11 (step 104).

The input screen B is for inputting the grid bias voltage of the charging unit 21 as the data for adjustment relating to the designated charging unit 21, and has a display of a mode name "adjustment mode", a code for adjustment "1234", a designated part "charging unit", a hierarchy "0", an adjustment object "grid bias", a current set value "600 V", an input field of a set value after change "_V", a numeral value up key for the set value input field, a numeral down key for the set value input field, a numeral stop key for the set value input field, a OK key, a cancel button and the like.

In the case where the cancel button of the input screen B is touch-operated because of a mistake in a designated part (NO at step 105, YES at step 106), return is made to the display of the designation screen A (step 102).

In the input screen B, when necessary input is completed and the OK key is touch-operated (YES at step 105), the adjustment corresponding to the input content is performed (step 107). After this execution, when there is no termination operation of the adjustment mode in the control panel 11 (NO at step 108), return is made to the display of the designation screen A (step 102). By returning to the display of the designation screen A, an adjustment to another part can be continued. In the case where the termination operation of the adjustment mode is performed (YES at step S108), the adjustment mode is terminated.

As described above, since the designation screen A is displayed, a part as an object of adjustment can be easily designated by the touch operation. Further, since the input screen B is displayed subsequently to the designation screen A, data for adjustment can be easily inputted.

It is unnecessary for the service man to memorize codes for adjustment, and it is unnecessary to refer to a manual in which codes for adjustment are set forth. A burden imposed on the service man is greatly reduced, and the efficiency of the adjustment work is greatly improved.

Incidentally, in the state where the designation screen A is displayed (step 102), it is also possible to change to the input screen B by inputting a code for adjustment by the control panel 11.

[2] Second embodiment will be described.

Figure 9:
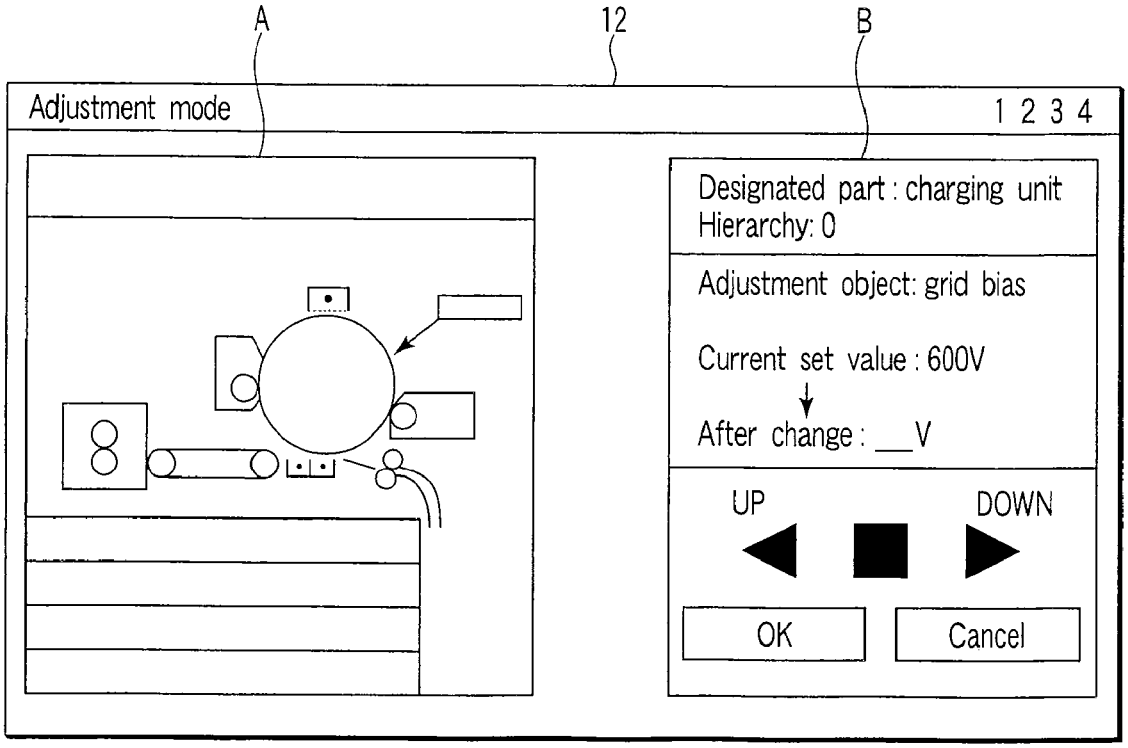
FIG. 9 is a view showing an input screen and a designation screen in the second embodiment.

When an adjustment mode is set, the designation screen A is displayed on the left area of the liquid crystal display part 12. When an adjustment part is designated on this designation screen A, as shown in FIG. 9, the input screen B is displayed on the right area of the liquid crystal display part 12.

Since the designation screen A and the input screen B are displayed side by side on one screen of the liquid crystal display part 12, the adjustment work can be performed while comparing the designation screen A and the input screen B with each other.

The other structure, operation and effect are the same as those of the first embodiment. Thus, their description will be omitted.

[3] Third embodiment will be described.

The CPU 20 has following means (11) to (14) as main functions.

(11) A first control section that sets an adjustment mode relating to plural parts of the apparatus according to an operation of the control panel 11.

(12) A second control section that includes means for causing the liquid crystal display part 12 of the control panel 11 to display at least one designation screen (first designation screen) A1 having an image display of the plural parts and for receiving designation of each of the parts of the image display at a time of setting of the adjustment mode, and means for causing the liquid crystal display part 12 of the control panel 11 to display at least one designation screen (second designation screen) A2 . . . to display plural adjustment items relating to the part designated on the designation screen A1 and for receiving designation of each of the adjustment items.

(13) A third control section that causes the liquid crystal display part 12 of the control panel 11 to display at least one input screen B for inputting data for adjustment relating to the adjustment item designated on the designation screen A2.

(14) A fourth control section that performs an adjustment corresponding to input content of the input screen B.

Figure 10:
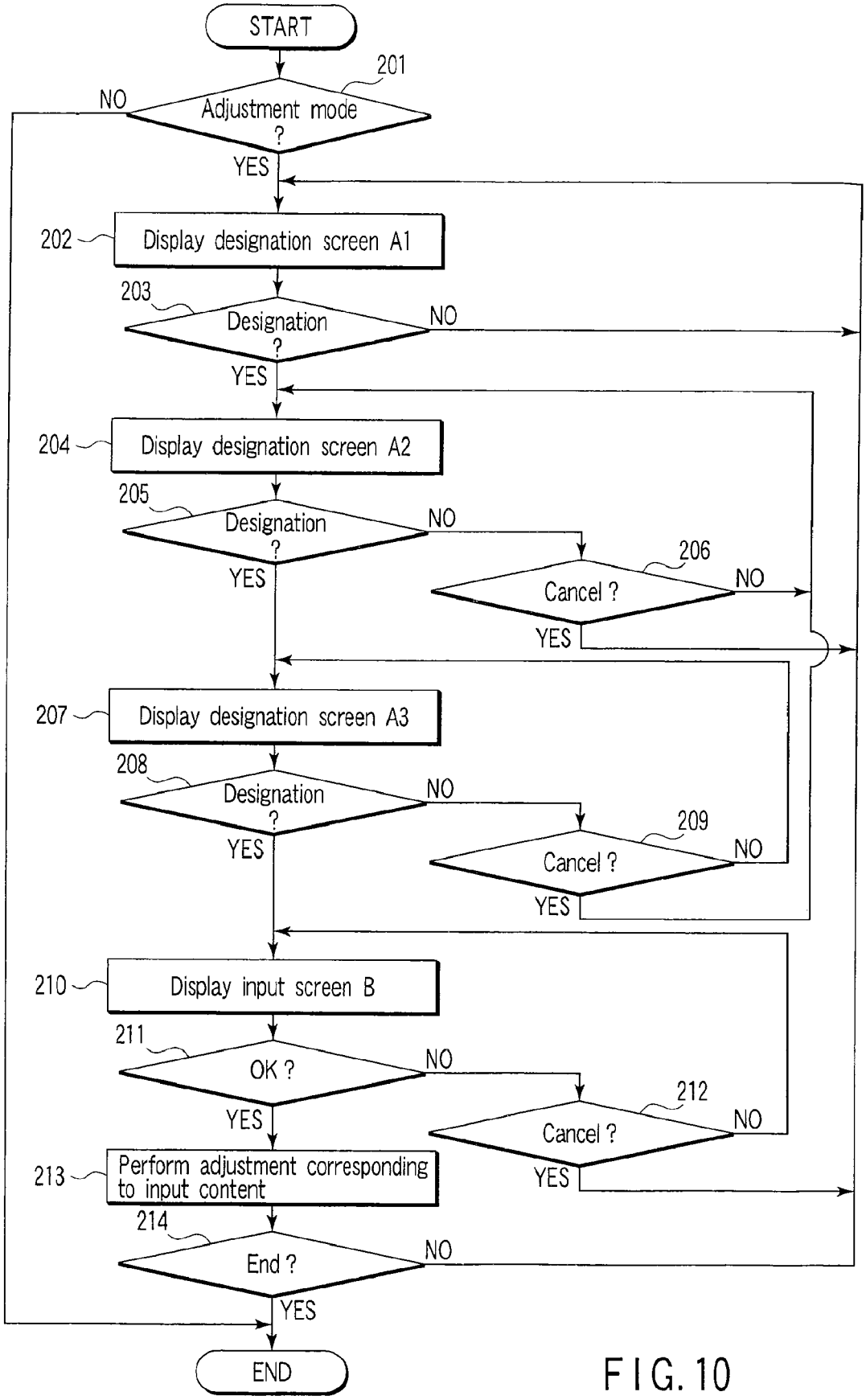
FIG. 10 is a flowchart for explaining an operation in a third embodiment.

Next, the operation will be described with reference to a flowchart of FIG. 10.

Figure 11:
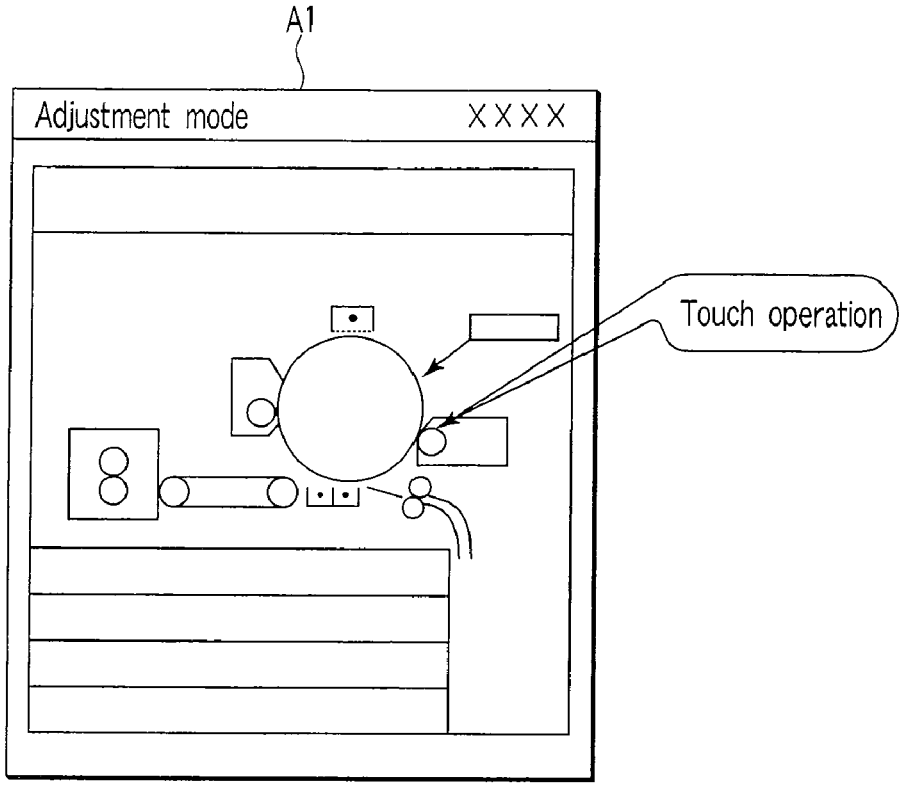
FIG. 11 is a view showing a first designation screen in the third embodiment.

When the adjustment mode is set (YES at step 201), a designation screen A1 shown in FIG. 11 is displayed on the liquid crystal display part 12 of the control panel 11 (step 202). The designation screen A1 has a display of a mode name "adjustment mode" and a code for adjustment "XXXX", and has an image display of the photosensitive drum 20, the charging unit 21, the developing unit 22, the transfer unit 23, the peeling unit 24, the cleaner 25, the laser unit 27, the register roller 33, the transport belt 41, the fixing unit 42 and the like in the printer 69, and is for receiving designation of a touch operation on each part of the image display.

Figure 12:
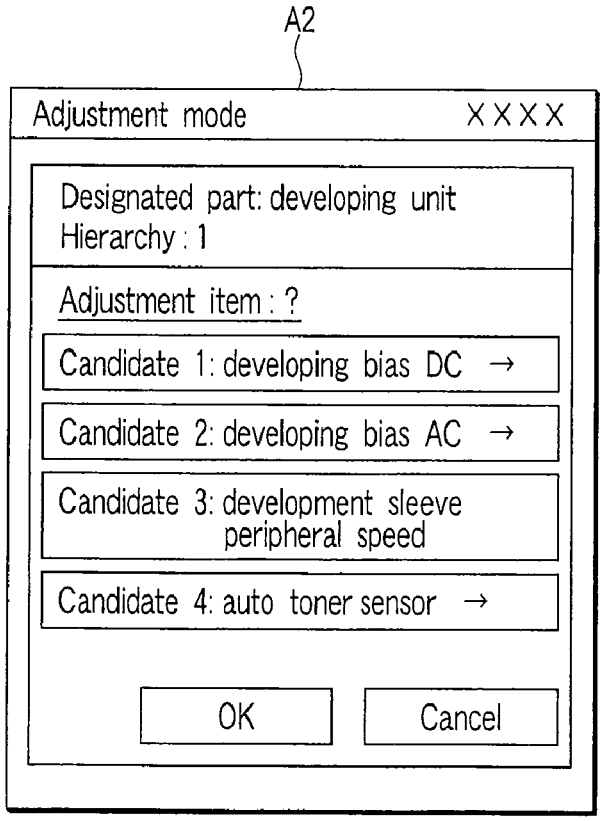
FIG. 12 is a view showing an initial second designation screen in the third embodiment.

When a portion, for example, the developing unit 22 of the image display of the designation screen A1 is designated by a touch operation (YES at step 203), the designation screen A2 shown in FIG. 12 is displayed on the liquid crystal display part 12 of the control panel 11 (step 204). The designation screen A2 has a mode name "adjustment mode", a code for adjustment "XXXX", a designated part "developing unit" and a hierarchy "1", and has a display of plural adjustment items of "developing bias DC (DC developing bias voltage)", "developing bias AC (AC developing bias voltage)", "development sleeve peripheral speed" and "auto toner sensor", which relate to the developing unit 22 designated on the designation screen A1, and has a display of a OK button and a cancel button, and is for receiving designation of each of the adjustment items.

On the designation screen A2, in the case where the cancel button is touch-operated (NO at step 205, YES at step 206), return is made to the display of the designation screen A1 (step 202).

Figure 13:
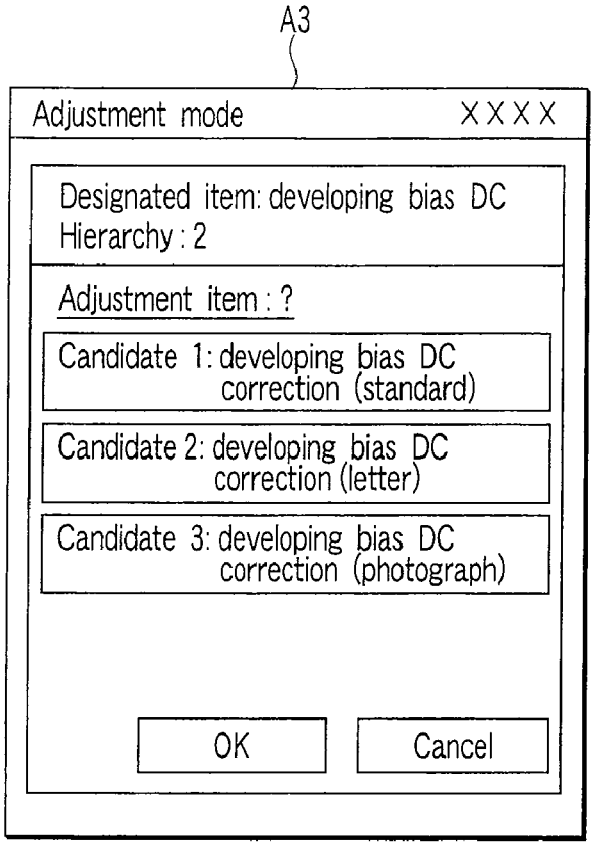
FIG. 13 is a view showing a next second designation screen in the third embodiment.

Among the respective adjustment items of the designation screen A2, for example, when the "developing bias DC" is designated by the touch operation (YES at step 205), a designation screen A3 shown in FIG. 13 is displayed on the liquid crystal display part 12 of the control panel 11 (step 207). The designation screen A3 has a mode name "adjustment mode", a code for adjustment "XXXX", a designated item "developing bias DC" and a hierarchy "2", has a display of plural adjustment items of "developing bias DC correction (standard)", "developing bias DC correction (letter)" and "developing bias DC correction (photograph)", which are in a hierarchy lower than the adjustment item "developing bias DC"

designated on the designation screen A2, has a display of a OK button and a cancel button, and is for receiving designation of each of the adjustment items.

On the designation screen A3, in the case where the cancel button is touch-operated and is designated (NO at step 208, YES at step 209), return is made to the display of the designation screen A2 (step 204).

Figure 14:
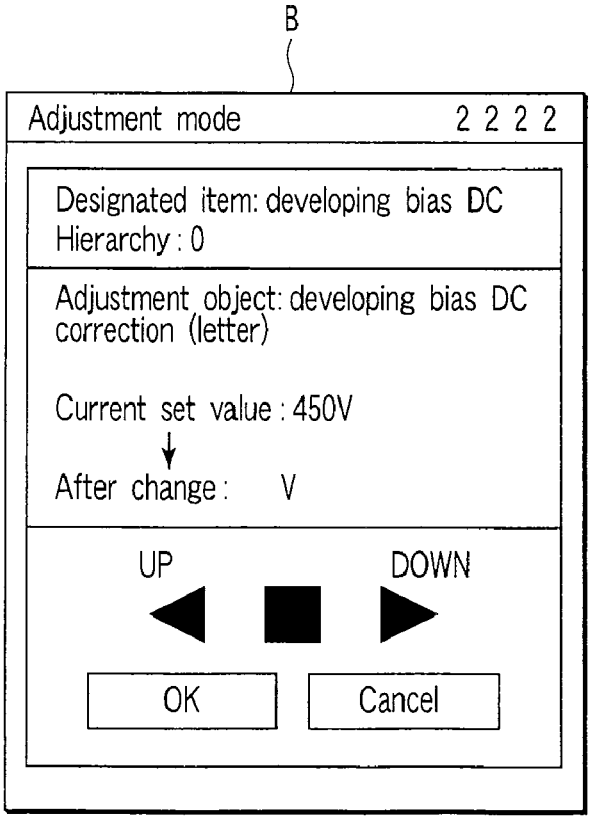
FIG. 14 is a view showing an input screen in the third embodiment.

When for example, the adjustment item "developing bias DC correction (letter)" of the designation screen A3 is designated by the touch operation (YES at step 208), an input screen B shown in FIG. 14 is displayed on the liquid crystal display part 12 of the control panel 11 (step 210).

The input screen B is for inputting the DC developing bias voltage of the developing unit 22 as the data for adjustment relating to the designated adjustment item "developing bias DC correction (letter)", and has a display of a mode name "adjustment mode", a code for adjustment "2222", a designated item "developing bias DC", a hierarchy "2", an adjustment object "developing bias DC correction (letter)", a current set value "450 V", a set value input field after change "_V", a numeral up key for the set value input field, a numeral down key for the set value input field, a numeral stop key for the set value input field, a OK button, a cancel button, and the like.

In the case where the cancel button of the input screen B is touch-operated because of a mistake in the designated part (NO at step 211, YES at step 212), return is made to the display of the designation screen A (step 202).

On the input screen B, when necessary input is completed and the OK button is touch-operated (YES at step 211), the adjustment corresponding to the input content is performed (step 213). After this execution, when the termination operation of the adjustment mode is not performed in the control panel 11 (NO at step 214), return is made to the designation screen A (step 202). By returning to the display of the designation screen A, an adjustment to another part can be continued. In the case where the termination operation of the adjustment mode is performed (YES at step 214), the adjustment mode is terminated.

As described above, since the designation screen A1 is displayed, a part as an object of adjustment can be easily designated by the touch operation. Further, since the designation screens A2 and A3 are displayed, even in the case where the designated part has many adjustment items, the many adjustment items can be easily designated by the touch operation. Further, since the input screen B is displayed subsequently to the designation screens A2 and A3, the data for adjustment can be easily inputted.

It is unnecessary for the service man to memorize codes for adjustment, and it is also unnecessary to refer to a manual in which the codes for adjustment are set forth. A burden imposed on the service man is greatly reduced, and the efficiency of the adjustment work is greatly improved.

The other structure, operation and effect are the same as those of the first embodiment. Thus, their description will be omitted.

[4] Incidentally, in the above respective embodiments, although the description has been given to the case where the object of adjustment is the printer 69, the adjustment can be performed also to other parts in the same way.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

It is claimed:

1. An image forming apparatus comprising:

a display part;

a first control section that sets an adjustment mode relating to plural parts of the apparatus;

a second control section that causes the display part to display at least one designation screen having an image display of the plural parts and for receiving designation of each of the parts of the image display at a time of setting of the adjustment mode;

a third control section that causes the display part to display at least one input screen for inputting data for adjustment relating to designated content of the designation screen; and a fourth control section that performs an adjustment corresponding to input content of the input screen.

2. An adjusting method of an image forming apparatus having a control panel including a display section and an operation section, comprising:

setting, using the operation section, an adjustment mode of the image forming apparatus;

displaying an image of a plurality of components of the image forming apparatus;

receiving a response on a selection of a component among the image of the plurality of components;

displaying an input screen relating to the selected component and a value inputted in the input screen; and performing an adjustment in accordance with the inputted value.

3. The adjusting method according to claim 2 wherein the plurality of components include a photosensitive drum, a charging unit, a developing unit, a transfer unit, a peeling unit, a cleaner, a laser unit, a register roller, a transport belt, and a fixing unit.

4. The adjusting method according to claim 2, wherein the inputted value is a grid bias or a developing bias voltage.

5. The adjusting method according to claim 2, wherein the display section is used for displaying the image of the plurality of components of the image forming apparatus, receiving the response on the section of the component among the image of the plurality of components, and displaying the input screen relating to the selected component and the value inputted in the input screen.

6. An adjusting method of an image forming apparatus comprising:

setting an adjustment mode of the image forming apparatus;

displaying an image of a plurality of components of the image forming apparatus, an input screen relating to at least one of the plurality of components, and a value for a grid bias voltage or a developing bias voltage inputted in the input screen; and performing an adjustment in accordance with the inputted value.

7. The adjusting method according to claim 6, wherein the plurality of components are selected from a photosensitive drum, a charging unit, a developing unit, a transfer unit, a peeling unit, a cleaner, a laser unit, a register roller, a transport belt, and a fixing unit.

8. The adjusting method according to claim 6, wherein the apparatus has a control panel including a display section and an operation section.

9. The adjusting method according to claim 8, wherein the operation section is used for setting the adjustment mode.

10. The adjusting method according to claim 8, wherein the display section is used for displaying the image of the plurality of components of the image forming apparatus, the input screen relating to at least one of plurality of components, and the value inputted in the input screen.

11. A regulating method of an image forming apparatus comprising:

setting an adjustment mode of the image forming apparatus;

displaying a representation of a plurality of components of the image forming apparatus, the plurality of components including a photosensitive drum, a charging unit, a developing unit, a transfer unit, a peeling unit, a cleaner, a laser unit, a register roller, a transport belt, and a fixing unit;

receiving a response on a selection of a component among the representation of the components;

displaying an input screen relating to the selected component and a valued inputted; and performing an adjustment in accordance with the inputted value.

12. The regulating method according to claim 11, wherein the inputted value is a grid bias voltage or a developing bias voltage.

13. The regulating method according to claim 11, wherein the apparatus has a control panel including a display section and an operation section.

14. The regulating method according to claim 13, wherein the operation section is used for setting the adjustment mode.

15. The regulating method according to claim 13, wherein the display section is used for displaying the representation of the plurality of components of the image forming apparatus, receiving the response on the selection of the component among the image of the plurality of components, and displaying the input screen relating to the selected component and the value inputted.

* * * * *